United States Patent [19]

Stockdale

[11] 4,003,045

[45] Jan. 11, 1977

[54] INTRUSION DETECTION SYSTEMS WITH TURBULENCE DISCRIMINATION

[75] Inventor: Roy Stockdale, Huntington, N.Y.

[73] Assignee: Napco Security Systems, Inc., Copiague, N.Y.

[22] Filed: Oct. 1, 1975

[21] Appl. No.: 618,692

[52] U.S. Cl. ..... 340/258 A; 343/5 PD

[51] Int. Cl.[2] ..... G08B 13/18

[58] Field of Search ..... 340/258 A; 343/7.7, 343/5 PD

[56] References Cited

UNITED STATES PATENTS

| | | | |
|---|---|---|---|
| 3,760,400 | 9/1973 | Galvin et al. | 340/258 A |
| 3,796,989 | 3/1974 | Ravas et al. | 340/258 A |
| 3,838,408 | 9/1974 | McMaster | 340/258 A |
| 3,845,461 | 10/1974 | Foreman | 340/258 A |
| 3,885,234 | 5/1975 | Fujimoto | 340/258 A |

*Primary Examiner*—Glen R. Swann, III
*Attorney, Agent, or Firm*—Arthur L. Plevy

[57] ABSTRACT

An intrusion alarm system employs ultrasonic frequencies and operates in the presence of turbulence. The system includes a differentiator and an integrator, each coupled to a sample and hold circuit; the differentiated pulses determining the level from the integrator, which level is stored in the sample and hold circuit during a predetermined time interval. The level, as stored, will be relatively constant for the presence of an intruder and will exhibit excursions during turbulence. A threshold circuit is responsive to the steady level during a predetermined period to sound an alarm determinative of an intrusion. During turbulence, the signal stored fluctuates and is discriminated against by the threshold circuit to assure that the alarm will not occur for this condition.

8 Claims, 2 Drawing Figures

INTRUSION DETECTION SYSTEMS WITH TURBULENCE DISCRIMINATION

BACKGROUND OF THE INVENTION

This invention relates to an intrusion detection system and more particularly to an ultrasonic system employing turbulence discrimination.

There are a great number of prior art patents and structures designated as intrusion detection systems and operative to indicate the presence of an intruder in a secure area. Many of such systems employ ultrasonic frequencies for transimission. As such, the ultrasonic signals are not audible; but are relatively low frequency signals as compared to microwave systems. Ultrasonic frequencies can be produced by a number of conventional techniques such as the Galton pipe, magnetostriction devices, piezoelectric devices and so on. In a typical ultrasonic system, an oscillator or ultrasonic transmitter provides an ultrasonic signal which is transmitted into an area to be protected. The intrusion system uses the well know Doppler effect to detect the presence of an intruder by monitoring movement.

Basically, the Doppler effect is produced when a vibrating source of waves (such as that produced by an ultrasonic transmitter), impinges on a moving target. Generally, as the source approaches the target, the frequency observed at a receiving location is higher than the frequency emitted by the source. If the source is receding, the observed frequency is lower. It is understood that motion is relative and either the source or target can move to provide the Doppler effect.

In any event, ultrasonic systems offer many advantages in the realm of intrusion detection. The sensitivity of such systems is good, as well as the fact, that the ultrasonic waves will not penetrate walls or other barriers; allowing for reliable monitoring of an enclosed area, without penetration of the waves beyond the area.

However, it is also well known that ultrasonic frequencies are randomly produced by all sorts of vibrating equipment and so on. The prior art is cognizant of such effects and hence, there are a number of prior art patents which indicate apparatus operative to discriminate against spurious signals.

Examples of interfering spurious sources encompass vibrating water pipes, horns, shattering glass, air conditioning and heating systems and so on.

A major factor of interference in ultrasonic systems resides in the action of air turbulence. Thus, normal air turbulence as that produced by the operation of a heating fan, air conditioner produces interfering signals which effect reliable intruder detection.

Many prior art patents exist which offer various solutions to the turbulence problem and include the following:

U.S. Pat. No. 2,794,974 entitled COMPENSATION FOR TURBULENCE AND OTHER EFFECTS IN INTRUDER DETECTION SYSTEMS by S. M. Bango, et al, issued June 4, 1957; U.S. Pat. No. 3,111,657 entitled COMPENSATION FOR TURBULENCE AND OTHER EFFECTS IN INTRUDER DETECTION SYSTEMS by S. M. Bango, et al, issued on Nov. 19, 1963; U.S. Pat. No. 3,638,210 entitled INTRUSION ALARM WITH TURBULENCE COMPENSATION by C. T. Hankins, et al, issued on Jan. 25, 1972; and U.S. Pat. No. 3,760,400 entitled INTRUSION DETECTION SYSTEM EMPLOYING QUADRATURE SAMPLING issued on Sept. 18, 1973 to A. Galvin, et al.

Particularly, U. S. Pat No. 3,760,400 depicts a system which, as other prior art references, recognizes that there is a difference between the signal caused by an intruder and the signal caused by turbulence. An intruder will cause a Doppler shift which can be represented by a sine wave having a relatively fixed frequency, while a signal produced by turbulence is a relatively random signal. Hence, the above noted patent utilizes a quadrature detector for examining the relationship of the wave form peaks to the wave form crossing points. In a regular sine wave, the quadrature phasing of the peak will always have the same relationship to the crossing points and hence, an intrusion is detected.

In any event, the circuit structure is complicated and expensive to fabricate.

It is therefore an object of the present invention to provide an improved ultrasonic system employing an inproved and reliable detector circuit for discriminating against turbulence.

BRIEF DESCRIPTION OF PREFERRED EMBODIMENT

An intrusion alarm system for detecting the presence of a moving target in the presence of interfering signals comprising of means for transmitting signals into a zone under surveillance; means for receiving signals returned from said zone; processing means operative in response to said received signals to provide an output signal, indicative of said moving target and said interfering signal; first means for differentiating said output signal; second means for integrating said output signal; detector means coupled to said first and second means and responsive to said differentiated signal to store a magnitude determinative of said integrated signal during a predetermined period selected according to the presence of an intruder and threshold means coupled to said detector means and operative to provide an alarm signal when said stored magnitude is relatively constant during said predetermined period.

DETAILED DESCRIPTION OF PREFERRED EMBODIMENT

Figure 1:
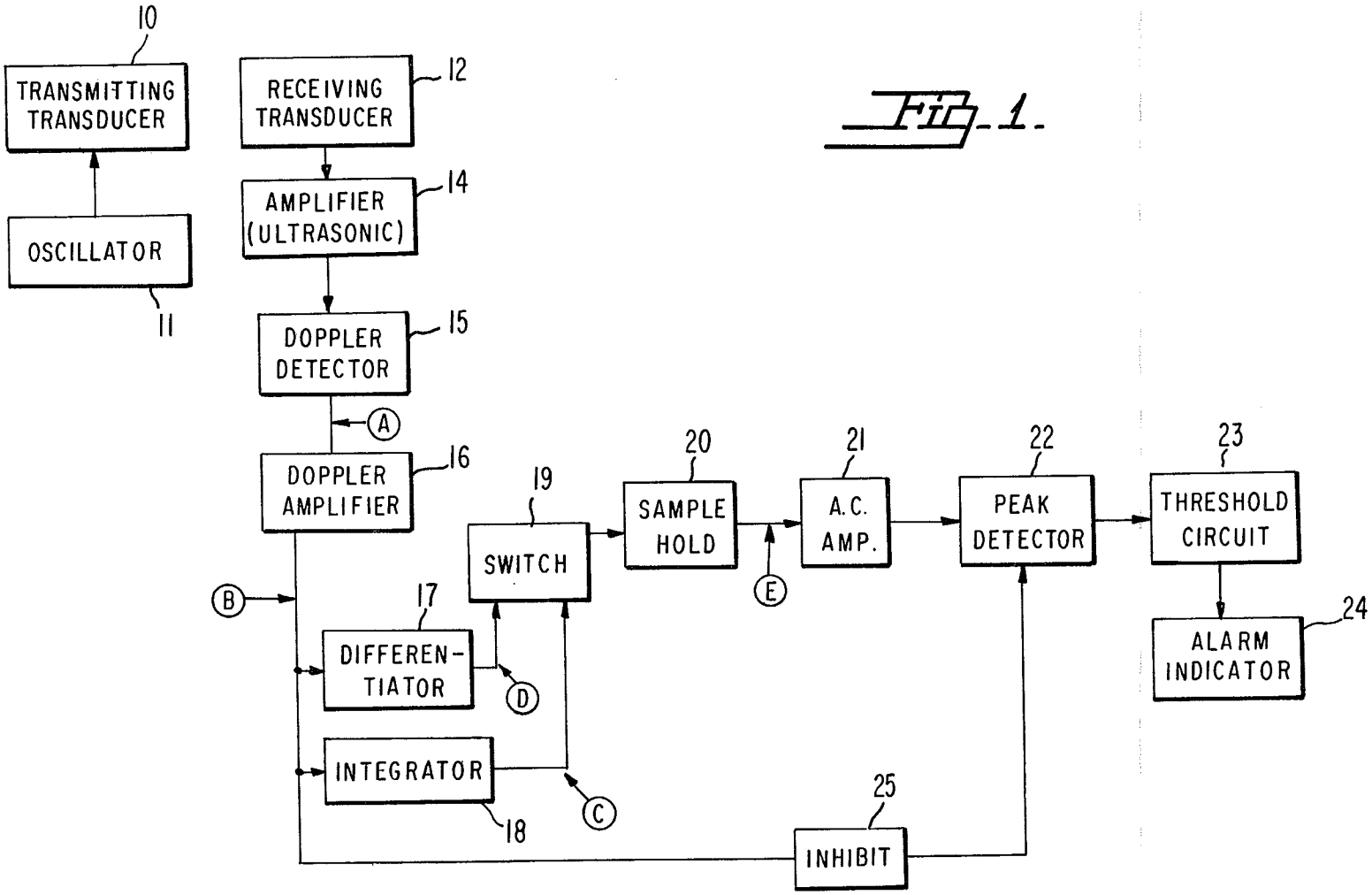
FIG. 1 is a block diagram of an intrusion detection system according to this invention.

An intrusion detector system is illustrated in block form in FIG. 1 and includes a transmitting transducer 10, which receives an ultrasonic signal from an oscillator 11. The transducer 10 is capable of directing ultrasonic energy in a predetermined pattern about an area under surveillance. As such, the transducer 10 may be a piezoelectric microphone and so on. Since the frequency of the ultrasonic band is relatively low (typically 19KHz to 5 OKHz), the oscillator 11 is of a conventional design.

The ultrasonic system also includes a receiving transducer 12, which may be the same type of transducer utilized in the transmitter. The receiving transducer 12 is responsive to reflected ultrasonic transmissions or those ultrasonic signals which impinge on the transducer 12. The receiving transducer 12 has an output coupled to the input of a typical amplifier circuit 14, which functions to linearly amplify the received signal for application of the same to the input of a Doppler detector circuit 15.

As briefly indicated above, if one transmits an ultrasonic signal at a particular carrier frequency, say 25KHz, for example, and a moving object is present in the area under surveillance, a Doppler shift will occur. The Doppler frequency is of the order of 15 to 1000Hz, dependent upon the velocity or motion of the target and appears in the signal reflected from the target. It is this signal that the receiver 12 is designed to detect or response to . Basically, the Doppler detector 15 may comprise a low-pass or band pass filter, operating within the anticipated Doppler range and hence, the carrier frequency (25 KHz) will not propogate through the filter or detector 15.

The low frequency Doppler signal from the detector 15 is applied to the input of the Doppler amplifier 16. Basically the amplifer 16 is a squarer and clipper circuit and the Doppler signal is therefore squared and clipped so as to provide a square wave type signal at the output of the amplifier 16.

The output of the amplifier 16 is coupled to a differentiator circuit 17 and to an integrator circuit 18. Integrator and differentiator circuits are well known in the art and may include active devices as operational amplifiers and so on to provide reliable and accurate operation.

The output of both the differentiator 17 and the integrator 18 are applied to the inputs of a switching circuit 19.

The switching circuit may for example, be an analog AND gate and operates to pass the output of the integrator 19 to a sample and hold circuit 20 only during the presence of a pulse from the differentiator 17. As will be explained, only one-half of the differentiated signal is used to operate the switch 19 and the level of the integrator 18 at the switching pulse is applied to the sample and hold circuit 20. Sample and hold circuits as 20 are also known in the art and may comprise FET's with capacitors and so on to provide large holding times.

The signal from the sample and hold circuit 20 is further amplified by an AC amplifier 21, whose output is applied to the input of a peak detector circuit 22. The peak detector circuit 22, also a conventional circuit arrangement, provides a signal dependent upon the peak value of the signal from the amplifier 21 and this signal is applied to a threshold circuit 23. The threshold 23 may be a differential amplifier or a Schmitt trigger and funtions to provide a predetermined output signal when the threshold level or value is exceeded by the signal emanating from the peak detector 22.

Hence, when this condition occurs, an alarm is activated or indicated by the alarm indicator circuit 24. The alarm indicator circuit 24 may be a relay, a bulb, a buzzer or some other audibile, visual device capable of indicating to a user or otherwise, that an alarm condition exists, which is determinative of the presence of an intruder.

Also shown coupled between the output of the Doppler amplifier 16 and an input to the peak detector 22, is an inhibit circuit 25.

The inhibit circuit 25 operates to disable the peak detector 22 during the absence of a signal from the Doppler amplifier 16 to prevent spurious alarms. The inhibit circuit 25 will also operate to determine a total signal threshold that the system will respond to. For example, random noise exists at relatively low levels and such noise could possible cause the system to operate to provide an alarm. Such random noise during a long time period may provide a signal which appears as an intrusion signal and hence, the inhibit circuit 25 is operative to prevent system operation by disabling the peak detector 22 when low level signals appear at the output of the amplifier 16. This then, assures that the signals which can cause an alarm have a sufficient amplitude to be fully and reliably processed by the circuitry included between the Doppler amplifier 16 and the alarm indicator 24.

Figure 2:
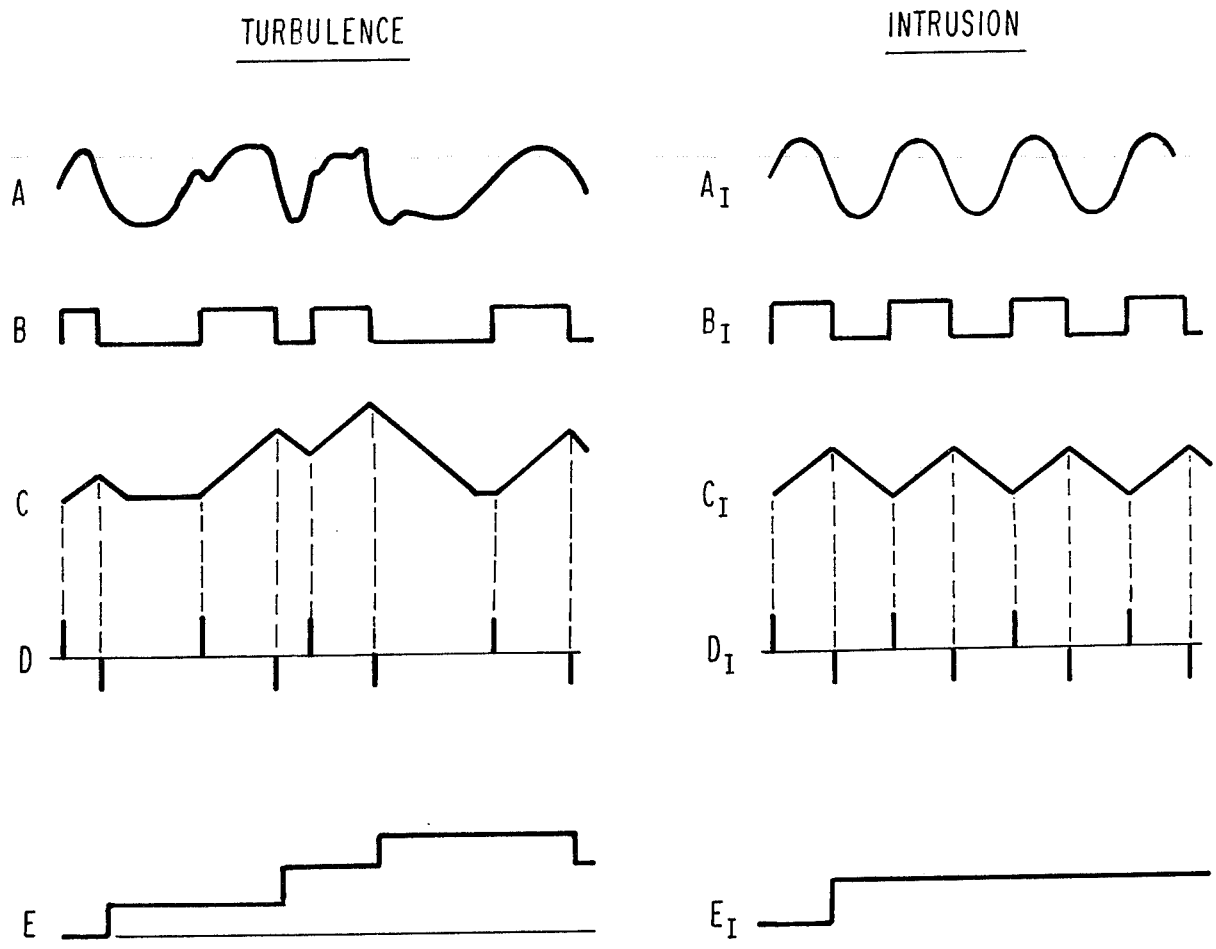
FIG. 2, including A through E, is a series of timing waveforms useful in explaining the operation of the invention.

Referring to FIG. 2, there is shown a series of waveforms useful in explaining the operation of the circuitry of FIG. 1 and pertinent to the differences in a turbulence signal as compared to a true intrusion signal.

Referring to FIGS. 2A and 2AI, there is shown respectively, a signal evidenced by turbulence (2A) and a signal representative of a true intrusion (2AI). As can be seen, the turbulence waveform is similar to a random noise signal and possesses no recurring pattern. The intrusion signal during a relatively extensive period appears as a regular periodic sine wave. This is so as an intruder must produce a Doppler shift which possesses a repetitive frequency during a relatively long time period.

As one can ascertain, an intruder cannot alter motion rapidly and hence, a person in motion will not be able to move for shorter periods than a quarter of a second or so. A quarter of a second corresponds to 250 milliseconds. For a Doppler shift of 1000HZ, an intruder will therefore produce 250 sine waves in the quarter of a second period. Even if one moved in a tenth of a second, one would produce 100 sine waves at a 1KHz rate. If the rate decreased to 500Hz, then the cycles produced will be halved and so on. In any event, it is apparent that an intruder must produce enough repetitive waves to be detected. A turbulent signal (2A) due to its random nature, will not provide enough continuous waves during a given period to be detected. The concept has been used by others to discriminate against turbulence.

The waveforms of FIGS. 2A and 2AI will appear at the output of the Doppler detector 15, which as indicated, may be a low pass or band pass filter due to the fact that the frequencies contained therein are within the Doppler band. It is, of course, realized that the turbulence signal of FIG. 2A contains many frequency components within the Doppler band, while the intrusion signal of FIG. 2AI is relative of a fundamental or single frequency.

The frequency of the intruder signal can of course, vary as the speed or motion of the intruder changes.

Referring to FIGS. 2B and 2BI, there is shown the squared and clipped version of both the turbulence signal and the intrusion signal as processed by the Doppler amplifer 16 of FIG. 1 and as appearing at the output thereof.

The turbulence signal (FIG. 2B) consists of a series of irregular pulses, each shown of a different width and separated by a differnt time interval as determined by the major excursions of the signal of FIG. 2A.

The random nature of the turbulent signal of FIG. 2A thus accounts for the waveform depicted in FIG. 2B. As is known, a clipped and squared sine wave will provide a square wave output as shown in FIG. 2BI.

Referring to FIGS. 2C and 2CI, there is shown the integrated signals obtained at the output of the integrator 18 of FIG. 1. The waveforms depicted in FIGS. 2D and 2DI depict the differentiated signals obtained at the output of the differentiator circuit 17 of FIG. 1.

A comparison of the waveforms of FIGS. 2C and D with those of FIGS. 2CI And DI indicate the differences between the turbulence signal and the intrusion signal.

Due to the random nature of the turbulence signal, a series of irregular spaced pulses appear the output of the differentiator 17, while the intrusion pulses are regularly spaced. The integrated waveform of the turbulence signal exhibits varying levels, while the intrusion signal exhibits excursions between two relatively fixed values.

As indicated, the switch circuit 19 is operative in responsive to one polarity pulse of the differentiator outut to apply to the sample and hold circuit 20, the voltage level present at the output of the intergrator circuit 18.

FIGS. 2E and 2EI show the output of the sample and hold circuit 20 for the turbulence waveform and the intrusion waveform respectively.

Assume that the switch 9 is activated for the negative differentiator pulses shown in FIGS. 2D and 2DI.

As one can ascertain, the level switched and stored in the sample and hold circuit varies as shown in FIG. 2E, due to the varying level of the integrated waveform of FIG. 2C.

However, referring to FIG. 2CI and FIG. 2EI, the amplitude due to the intrusion signal, is constant as the integrated waveform is repetitive and the neagative differentiated pulses occur at the same repetition rate.

Hence, it is immediately ascertained that one can discriminate between the intrusion signal and turbulence signal by recognizing that the turbulence signal at the output of the sample and hold circuit 20 is always irregular, while the intrusion signal is relatively a fixed value due to the repetitive nature of the Doppler waveform.

The intrusion signal as amplified by amplifier 21 and detected, operates the threshold circuit 23 to indicate an alarm status, while the turbulence signal does not.

The implementation of the circuitry shown in FIG. 1 is well within the ken of one skilled in the art. For examples of suitable sample and hold circuits, peak detectors as well as threshold circuits, reference is made to a text entitled "Guidebook of Electronic Circuits" by John Markus, published by McGraw-Hill Book Company, 1974.

It is noted that the inhibit circuit 25 may be a simple OR gate which will provide a level sufficient to bias the peak detector only during the presence of stronger signals from the Doppler amplifier 16. The inhibit is necessary as one may experience a condition where there is no substantial turbulence signal and hence, this would appear as a continuous signal and cause a false alarm. The threshold circuit merely has to detect the presence of a continuous signal (FIG. 2EI) for a predetermined period, say one quarter of a second and thereafter deactivate the alarm circuit. If the signal from the peak dectector 22 exhibits variations, one then assumes it is a turbulence and the threshold circuit does not respond.

Typical movements as caused by small animals, water pipes and so on, can be discriminated against by setting the threshold circuit according to amplitude strictly due to the physical size of a true intruder as compared to such entities.

The turbulence which is therefore discriminated against by the above system is that which causes a refraction of the ultrasonic waves due to thermal and other effects, thus resulting in random signals within the Doppler range and not necessarily accompanied by spurious movement.

I claim:

1. An intrusion alarm system for detecting the presence of a moving target in the presence of interfering signals, comprising:
   a. means for transmitting signals into a zone under surveillance,
   b. means for receiving signals returned from said zone,
   c. processing means operative in response to said received signals to provide an output signal, indicative of said moving target and said interfering signal,
   d. first means for differentiating said output signal,
   e. second means for integrating said output signal,
   f. detector means coupled to said first and second means and responsive to said differentiated signal to store a magnitude proportional to said integrated signal during a predetermined period
   g. threshold means coupled to said detector means and operative to provide an alarm signal when said stored magnitude is relatively constant during said predetermined period.

2. The intrusion alarm system according to claim 1 wherein said detector means comprises a sample and hold circuit having a storage input coupled to said second means for storing therein a level proportional to the magnitude of said integrated output signal and a control input coupled to said first means for determining the time said level is to be stored.

3. The intrusion alarm system according to claim 2 wherein said threshold means include:
   a. an AC amplifier having an input coupled to the output of said sample and hold circuit and operative to amplify said stored level at an output terminal, and
   b. a peak detector coupled to said output terminal of said AC amplifier and operative to provide a signal indicative of the peak value of said level as stored.

4. The intrusion alarm system according to claim 1 further comprising:
   a. means coupled between said processing means and said threshold means for inhibiting said threshold means for output signal levels below a predetermined value.

5. The intrusion alarm system according to claim 1 wherein said means for transmitting signals into said zone include an ultrasonic oscillator circuit.

6. The intrusion alarm system according to claim 1 further including an alarm circuit coupled to said threshold means and responsive to said alarm signal for providing an alarm indication determinative of the presence of an intruder 7. The intrusion alarm system according to claim 3 wherein said threshold means further includes a Schmitt trigger.

8. The intrusion alarm system according to claim 1 wherein said output signal has a frequency range within 15 to 1000 Hz as determined by the rate of motion of said moving target.

* * * * *